US005962850A

United States Patent [19]

Wüest

[11] Patent Number: 5,962,850

[45] Date of Patent: Oct. 5, 1999

[54] LARGE APERTURE PARTICLE DETECTOR WITH INTEGRATED ANTENNA

[75] Inventor: Martin Peter Wüest, San Antonio, Tex.

[73] Assignee: Southwest Research Institute, San Antonio, Tex.

[21] Appl. No.: 09/034,648

[22] Filed: Mar. 4, 1998

[51] Int. Cl.[6] ..... H01J 49/40

[52] U.S. Cl. ..... 250/287; 250/283; 250/397

[58] Field of Search ..... 250/287, 283, 250/397

[56] References Cited

U.S. PATENT DOCUMENTS

| | | | |
|---|---|---|---|
| 2,972,743 | 2/1961 | Svensson et al. | 343/838 |
| 3,271,771 | 9/1966 | Hannan et al. | 343/756 |
| 3,679,896 | 7/1972 | Wardly | 250/41.9 ME |
| 4,788,555 | 11/1988 | Schultz et al. | 343/840 |
| 4,849,629 | 7/1989 | Daimon et al. | 250/305 |
| 4,866,454 | 9/1989 | Droessler et al. | 343/725 |
| 5,107,111 | 4/1992 | Daimon et al. | 250/205 |
| 5,144,127 | 9/1992 | Williams et al. | 250/287 |

FOREIGN PATENT DOCUMENTS

| | | |
|---|---|---|
| 2752-547 | 5/1979 | Germany . |
| 58-78360 | 5/1983 | Japan . |
| 2 221 082 | 1/1990 | United Kingdom . |

*Primary Examiner*—Kiet T. Nguyen
*Attorney, Agent, or Firm*—Taylor Russell & Russell, P.C.

[57] ABSTRACT

A large aperture particle detector integrated with an electromagnetic antenna. By combining functions of spacecraft subsystems into a single integrated system, a larger particle collector is achieved to provide greater particle measuring sensitivity and costs are reduced through consolidation of functions. The integrated subsystems include a conventional high-gain spacecraft dish antenna and a large aperture particle collector. The conventional high-gain spacecraft dish antenna reflects and focuses impinging electromagnetic radiation at an electromagnetic detector and source, and may comprise one or more reflecting and focusing surfaces. The antenna is used to transmit and receive electromagnetic radiation. The large aperture particle collector is collocated with the electromagnetic antenna. The large aperture particle collector reflects and focuses impinging charged particles at a particle detector through the use of one or more electrostatic mirrors. The electrical potential applied to the electrostatic mirrors may be adjusted to select particles having a specific range of particle energies to be reflected and focused on the particle detector.

54 Claims, 4 Drawing Sheets

LARGE APERTURE PARTICLE DETECTOR WITH INTEGRATED ANTENNA

BACKGROUND

The invention relates generally to the fields of particle detectors and antennas, and, more particularly, to an integrated particle detector and electromagnetic antenna apparatus that provides a large aperture for efficient collection of charged particles and electromagnetic radiation and transmission of electromagnetic radiation.

Space physics is the science concerned with the study of the plasmas or collections of charged particles such as ions and electrons that are encountered in space. One of the methods used in the study of plasmas is the in-situ analysis of the particles according to their energy, mass, and charge. The instruments used to determine these plasma parameters include energy-per-charge analyzers, mass-per-charge analyzers, magnetic or time-of-flight mass spectrometers, and instrumentation based on the energy loss in matter. One of the important parameters of particle analyzer instrumentation is the sensitivity, which is related to the geometric factor $G_i$, which in turn is related to the collection area. Therefore, one way to increase the sensitivity of the plasma instrumentation is to increase the collection or aperture area. There has indeed been a trend toward larger instruments with larger geometric factors.

To understand the measurement process in particle instrumentation, consider the relationship between the particle distribution function $f_i(E)$ for particle species i and the telemetered quantities of detector count rate $C_i$, particle energy E, and mass $M_i$:

$$f_i(E)=C_iM_i^2/(G_iE^2)[s^3m^{-6}].$$

The factor $G_i$ is the energy-geometric factor, which is approximately constant with energy for a given instrument and particle species. The value $G_i$ expresses the instrument response in terms of its sensitive area A, its angular acceptance $\Omega$, energy acceptance $\Delta E/E$, detector efficiency $\epsilon_i$, and the grid transmission T. In general, $G_i$ may be written as $$G_i=A\Omega T\epsilon_i(\Delta E/E)[m^2sr],$$

where $\Omega$ represents the averaged angular response and $\Delta E/E$ represents the averaged energy response normalized to the energy of the central particle trajectory.

The quality of the measurement $f_i(E)$ is thus seen to be determined by the minimum detectable count rate and by the instrumental constant $G_i$. Because the limiting minimum detectable count rate is set by detector noise and by the background due to high energy radiation in the space environment, the only practical way to make an instrument more sensitive to $f_i(E)$ is to increase the size of the constant $G_i$. $G_i$ is increased by increasing the area A, the acceptance angle $\Omega$, the detector efficiency $\epsilon_i$, or the grid transmission T. The present invention is mainly concerned with increasing the collection area A.

In applications involving plasma particle detection in space, there is a need for having a large collection area for collecting as many particles as possible in the tenuous medium in order to increase sensitivity and to allow for shorter integration times. For example, the density of the solar wind decays with the radial distance r from the Sun by the inverse square law, or $1/r^2$. For an instrument in the outer solar system to have the same sensitivity as at one astronomical unit, or the mean distance from the Earth to the Sun, its collection area needs to be increased by a similar factor.

Also, the solar wind consists largely of ionized hydrogen, mixed with about four percent of ionized helium and fewer ions of heavier elements. An increase in the collection area of the instrumentation beyond that currently being flown on spacecraft would improve the sensitivity and thereby the temporal resolution for the detection of ions comprising a small population of the solar wind.

Large particle collectors have been fielded in the past. However, these detectors were flat, passive metal foils with no concentrator. The foils were required to be retrieved and returned to Earth for analysis in the laboratory. The present invention, however, uses a large collection area and focuses particles on a sensor. The sensor can be an active sensor for in-situ analysis of the collected particles.

Recently, the paradigm has shifted in space research from a few comprehensive missions to a greater number of more narrowly focused missions. At the same time, cost had to be reduced, leading to an emphasis on "faster, better, and cheaper" missions. As a consequence, new missions require smaller, yet more capable and sensitive instrumentation. This has lead to a higher degree of integration of the spacecraft and its subsystems.

One of the largest structural elements of a spacecraft is its high-gain antenna, which often consists of a parabolic dish. This is particularly true for interplanetary spacecraft. With the move towards miniaturization and cost reduction, it is undesirable to have two large separate collectors on the spacecraft, one for electromagnetic radiation and one for particles.

For the foregoing reasons, there is a need for a large particle collector device that can provide high particle collection sensitivity and be integrated with a large electromagnetic collector device resulting in reduced cost and spacecraft size.

SUMMARY

The present invention is directed to a device that satisfies these needs. The present invention provides for a large particle collector device that can provide high particle collection sensitivity and be integrated with a large electromagnetic collector device resulting in reduced spacecraft size and cost. The invention consists of a large collecting area for collecting as many particles as possible in a tenuous medium such as space. This large particle collector is shaped in a form to concentrate the particles and focus them into an entry slit of a conventional particle analyzer or onto a particle detector. The integration with the large electromagnetic collector is accomplished by using a number of grids at different electrical potentials to reflect particles and electromagnetic radiation. There are a number of possible configurations for the placement of the particle detector in relation to the overall mechanical structure and in relation to the electromagnetic detector and source.

For a typical application in space science, the integration of a large particle collector with a large electromagnetic collector reduces overall spacecraft size since only one large collector rather than two large collectors need to be built and deployed. Since a high-gain electromagnetic antenna is usually much larger than previous particle collectors flown in space, the particle collection efficiency is increased substantially, allowing a higher sensitivity in particle collection.

A device having features of the present invention is a particle collector with an integrated antenna comprising a shaped dish antenna for transmitting and receiving incident electromagnetic radiation having an antenna radius and an electromagnetic focus point for incident electromagnetic radiation. It also comprises a shaped, electrically conductive primary particle reflection grid having a smaller primary reflection grid radius than the dish antenna radius and positioned within the dish antenna, the primary reflection grid being held at an electrical potential for reflecting electrically charged particles. Also included is a shaped, electrically conductive primary reference grid having a smaller primary reference grid radius than the primary reflection grid radius and positioned within the primary reflection grid, the primary reference grid being held at a ground reference electrical potential, the primary reflection grid and the primary reference grid having a common particle focus point for the reflected electrically charged particles. The present invention also comprises an electromagnetic radiation detector and source positioned at the electromagnetic focus point, and a particle detector positioned at the particle focus point.

Another embodiment of the present invention is a particle collector with integrated antenna wherein the antenna has an inner surface nearest to the electromagnetic focus point and an outer surface opposite the inner surface. The primary reflection grid is superimposed on the inner surface of the antenna, and the primary reflection grid is held at an electrical potential for reflecting the electrically charged particles to the particle detector. The outer surface of the antenna is an electrically conductive surface being held at the ground reference electrical potential for reflecting the incident electromagnetic radiation to the electromagnetic radiation detector and source.

In another embodiment, the antenna has an inner surface nearest to the electromagnetic focus point and an outer surface opposite the inner surface. The primary reflection grid is superimposed on the inner surface of the antenna, and the primary reflection grid is held at an electrical potential for reflecting the electrically charged particles to the particle detector. The inner surface comprising the primary reflection grid is an electrically conductive surface for reflecting the incident electromagnetic radiation to the electromagnetic radiation detector and source.

Another variation is where the shape of the dish antenna is derived from surfaces of second or higher order. The shape of the dish antenna may also be selected from a group consisting of parabolic, spherical, cylindrical, and hyperbolic. The shape of the primary particle reflection grid may be derived from surfaces of second or higher order. The shape of the primary particle reflection grid may also be selected from a group consisting of parabolic, spherical, cylindrical, and hyperbolic. The shape of the primary reference grid may be derived from surfaces of second or higher order. The shape of the primary reference grid may also be selected from a group consisting of parabolic, spherical, cylindrical, and hyperbolic. The particle detector may be selected from a group consisting of a mass spectrometer, a solid-state detector, a Faraday cup, a plasma analyzer, a channel electron multiplier, a microchannel plate detector, a microsphere plate detector, a carbon foil detector, a metal foil detector, a gas detector, a photomultiplier, and a photographic detector. Most of these detectors utilize electrical integration of the particle detection count over time to provide a higher sensitivity to the desired signal in a noisy background.

In other embodiments, the primary particle reflection grid has a mesh size that attenuates transmission and enhances reflection of incident electromagnetic radiation having wavelengths greater than the mesh size, and enhances transmission and attenuates reflection of incident electromagnetic radiation having wavelengths less than the mesh size. The primary reference grid may also have a mesh size that attenuates transmission and enhances reflection of incident electromagnetic radiation having wavelengths greater than the mesh size, and enhances transmission and attenuates reflection of incident electromagnetic radiation having wavelengths less than the mesh size. The electrical potential on the primary particle reflection grid relative to the ground reference electrical potential on the primary reference grid may be varied to select an energy range of the charged particles to be collected and focused at the particle detector. The shaped primary particle reflection grid may be concentric with the shaped primary reference grid and concentric with the shaped dish antenna. The shaped primary particle reflection grid may be concentric with the shaped primary reference grid and non-concentric with the shaped dish antenna. The shaped primary particle reflection grid may be concentric with the shaped dish antenna and non-concentric with the shaped primary reference grid. The shaped primary particle reflection grid may be non-concentric with the shaped primary reference grid, and the shaped primary reference grid may be non-concentric with the shaped dish antenna. The shaped primary particle reflection grid may be non-concentric with the shaped dish antenna, and the shaped primary reference grid may be concentric with the shaped dish antenna. The primary reference grid may have a mesh size that is smaller than the mesh size of the primary particle reflection grid to minimize electric field penetration into space without substantially reducing transmission of incident electromagnetic radiation.

In alternative embodiments, the particle collector with integrated antenna further comprises a plurality of non-concentric shaped, electrically conductive primary particle reflection grids positioned within the dish antenna and spaced between the dish antenna and the primary reference grid. The mesh size for each of the plurality of primary particle reflection grids may be progressively decreased for each grid position progressively closer to the dish antenna for selectively transmitting the incident electromagnetic radiation having wavelengths less than the respective mesh size, and selectively reflecting the incident electromagnetic radiation having wavelengths greater than the respective mesh size. An electrical potential may be applied to each of the plurality of primary particle reflection grids, the electrical potential applied is progressively increased for each grid position progressively closer to the dish antenna for selectively reflecting charged particles with progressively increasing energy. The primary reference grid may have a mesh size that is less than the wavelength of the incident electromagnetic radiation for reflecting the incident electromagnetic radiation to the electromagnetic radiation detector and source.

In another embodiment of the present invention, a particle collector with an integrated antenna comprises a shaped dish antenna for transmitting and receiving incident electromagnetic radiation having an antenna radius and an electromagnetic focus point for electromagnetic radiation. It also comprises a shaped, electrically conductive primary particle reflection grid having a smaller primary reflection grid radius than the dish antenna radius and positioned within the dish antenna, the primary reflection grid being held at an electrical potential for reflecting electrically charged particles. A shaped, electrically conductive primary reference grid has a smaller primary reference grid radius than the primary reflection grid radius and is positioned within the primary reflection grid, the primary reference grid being held at a ground reference electrical potential, the primary reflection grid and the primary reference grid having a common particle focus point for the electrically charged particles. An electromagnetic radiation detector and source is positioned at the electromagnetic focus point. A concave-shaped, electrically conductive secondary particle reflection grid is positioned at the common particle focus point, the secondary reflection grid having a secondary reflection grid radius and being held at a secondary electrical potential for reflecting electrically charged particles. A concave-shaped, electrically conductive secondary reference grid may have a smaller secondary reference grid radius than the secondary reflection grid radius and is positioned within the secondary reflection grid, the secondary reference grid being held at the ground reference electrical potential, the secondary reflection grid and the secondary reference grid having a common secondary particle focus point for charged particles, the secondary particle focus point being positioned behind an aperture in the antenna opposite the common particle focus point. A particle detector is positioned at the secondary particle focus point. An alternative embodiment includes the secondary reflection grid being a surface.

Other alternative embodiments include a particle collector with integrated antenna wherein the antenna has an inner surface nearest to the electromagnetic focus point and an outer surface opposite the inner surface. The primary reflection grid is superimposed on the inner surface of the antenna, the primary reflection grid being held at an electrical potential for reflecting the electrically charged particles to the secondary reflection grid. The outer surface of the antenna is an electrically conductive surface being held at the ground reference electrical potential for reflecting the incident electromagnetic radiation to the electromagnetic radiation detector and source. Alternatives include a particle collector with integrated antenna wherein the primary reference grid has a mesh size that is less than the wavelength of the incident electromagnetic radiation for reflecting the incident electromagnetic radiation to the electromagnetic radiation detector and source. The secondary reflection grid may be convex-shaped and the secondary reference grid may be convex-shaped.

An alternative embodiment is a particle collector with integrated antenna comprising a shaped dish antenna for transmitting and receiving electromagnetic radiation that has an antenna radius and an electromagnetic focus point for electromagnetic radiation. Also included is a shaped, electrically conductive primary particle reflection grid having a smaller primary reflection grid radius than the dish antenna radius and positioned within the dish antenna, the primary reflection grid being held at an electrical potential for reflecting electrically charged particles. This embodiment also includes a shaped, electrically conductive primary reference grid having a smaller primary reference grid radius than the primary reflection grid radius and positioned within the primary reflection grid, the primary reference grid being held at a ground reference electrical potential, the primary reflection grid and the primary reference grid having a common particle focus point for electrically charged particles. A particle detector is positioned at the particle focus point. A secondary electromagnetic radiation reflecting means is positioned at the electromagnetic focus point for reflecting and focusing the incident electromagnetic radiation at a secondary electromagnetic focus point, the secondary electromagnetic focus point being positioned behind a primary reference grid aperture and an aperture in the antenna. An electromagnetic radiation detector and source is positioned at the secondary electromagnetic focus point. The antenna may have an inner surface nearest to the electromagnetic focus point and an outer surface opposite the inner surface, wherein a primary reflection grid is superimposed on the inner surface of the antenna with the primary reflection grid being held at an electrical potential for reflecting electrically charged particles to the secondary reflection grid, and wherein the outer surface of the antenna is an electrically conductive surface being held at the ground reference potential for reflecting the incident electromagnetic radiation to the secondary electromagnetic reflecting means. The primary reference grid may have a mesh size that is less than the wavelength of the incident electromagnetic radiation for reflecting the incident electromagnetic radiation to the electromagnetic radiation detector and source. The secondary electromagnetic reflecting means may be either concave-shaped or convex-shaped.

Another embodiment is a particle collector with integrated antenna comprising a shaped dish antenna for transmitting and receiving incident electromagnetic radiation having an antenna radius and an electromagnetic focus point for electromagnetic radiation. It includes a shaped, electrically conductive primary particle reflection grid having a smaller primary reflection grid radius than the dish antenna radius and positioned within the dish antenna, the primary reflection grid being held at an electrical potential for reflecting electrically charged particles. A shaped, electrically conductive primary reference grid having a smaller primary reference grid radius than the primary reflection grid radius is positioned within the primary reflection grid, the primary reference grid being held at a ground reference electrical potential, the primary reflection grid and the primary reference grid having a common particle focus point for the electrically charged particles. A concave-shaped, electrically conductive secondary particle reflection grid is positioned at the common particle focus point, the secondary reflection grid having a secondary reflection grid radius and being held at a secondary electrical potential for reflecting electrically charged particles. A concave-shaped, electrically conductive secondary reference grid having a smaller secondary reference grid radius than the secondary reflection grid radius is positioned within the secondary reflection grid, the secondary reference grid being held at the ground reference electrical potential, the secondary reflection grid and the secondary reference grid having a common secondary particle focus point for charged particles, the secondary particle focus point being positioned adjacent to the antenna. A particle detector is positioned at the secondary particle focus point and a secondary electromagnetic reflecting means is positioned at the electromagnetic focus point for reflecting and focusing the incident electromagnetic radiation at a secondary electromagnetic focus point, the secondary electromagnetic focus point being positioned behind a primary reference grid aperture and adjacent to the antenna. Also included is an electromagnetic radiation detector and source positioned at the secondary electromagnetic focus point.

Alternatives include a particle collector with integrated antenna wherein the secondary electromagnetic reflecting means is the secondary reference grid having a mesh size smaller than the wavelength of the incident electromagnetic radiation. The secondary electromagnetic reflecting means may be the secondary reflection grid having a mesh size smaller than the wavelength of the incident electromagnetic radiation. The secondary reflection grid may also be a surface. In a further embodiment, the antenna has an inner surface nearest to the electromagnetic focus point and an outer surface opposite the inner surface. The primary reflection grid is superimposed on the inner surface of the antenna, the primary reflection grid being held at an electrical potential for reflecting electrically charged particles to the secondary reflection grid. The outer surface of the antenna is an electrically conductive surface being held at the ground reference electrical potential for reflecting the incident electromagnetic radiation to the secondary electromagnetic reflecting means. The primary reference grid may. have a mesh size that is less than the wavelength of the incident electromagnetic radiation for reflecting the incident electromagnetic radiation to the electromagnetic radiation detector and source. The secondary reflection grid may be convex-shaped and the secondary reference grid may be convex-shaped. The secondary electromagnetic reflecting means may be either concave-shaped or convex-shaped.

In an embodiment of the present invention, a particle collector with integrated antenna comprises a shaped dish antenna positioned above a surface for transmitting and receiving incident electromagnetic radiation, the dish antenna having an antenna radius and an electromagnetic focus point on the surface for the incident electromagnetic radiation. It further comprises a shaped, electrically conductive primary particle reflection grid positioned above the surface, having a smaller primary reflection grid radius than the dish antenna radius and positioned within the dish antenna, the primary reflection grid being held at an electrical potential for reflecting electrically charged particles. A shaped, electrically conductive primary reference grid is positioned above the surface, having a smaller primary reference grid radius than the primary reflection grid radius and positioned within the primary reflection grid, the primary reference grid being held at a ground reference electrical potential, the primary reflection grid and the primary reference grid having a common particle focus point on the surface for the electrically charged particles. An electromagnetic radiation detector and source is positioned at the electromagnetic focus point on the surface, and a particle detector is positioned at the particle focus point on the surface.

Alternative embodiments of this embodiment include a particle collector with integrated antenna wherein the dish antenna has an inner surface nearest to the electromagnetic focus point and an outer surface opposite the inner surface. The primary reflection grid is superimposed on the inner surface of the antenna, the primary reflection grid being held at an electrical potential for reflecting the electrically charged particles to the particle detector. And the outer surface of the antenna is an electrically conductive surface being held at the ground reference electrical potential for reflecting the incident electromagnetic radiation to the electromagnetic radiation detector and source. The primary reference grid may have a mesh size that is less than the wavelength of the incident electromagnetic radiation for reflecting the incident electromagnetic radiation to the electromagnetic radiation detector and source. The electrical potential on the primary particle reflection grid relative to the ground reference electrical potential on the primary reference grid may be varied to select an energy range of the charged particles to be collected and focused at the particle detector. The shape of the dish antenna is selected from a group consisting of partial parabolic, partial spherical, partial cylindrical, and partial hyperbolic. The shape of the primary particle reflection grid is selected from a group consisting of partial parabolic, partial spherical, partial cylindrical, and partial hyperbolic. The shape of the primary reference grid is selected from a group consisting of partial parabolic, partial spherical, partial cylindrical, and partial hyperbolic.

These embodiments describe a highly integrated electromagnetic antenna and particle collection system that satisfies the need for a large collection area to collect as many particles as possible in a tenuous medium in order to increase sensitivity and to allow for shorter electrical integration times of the particle count signal input.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
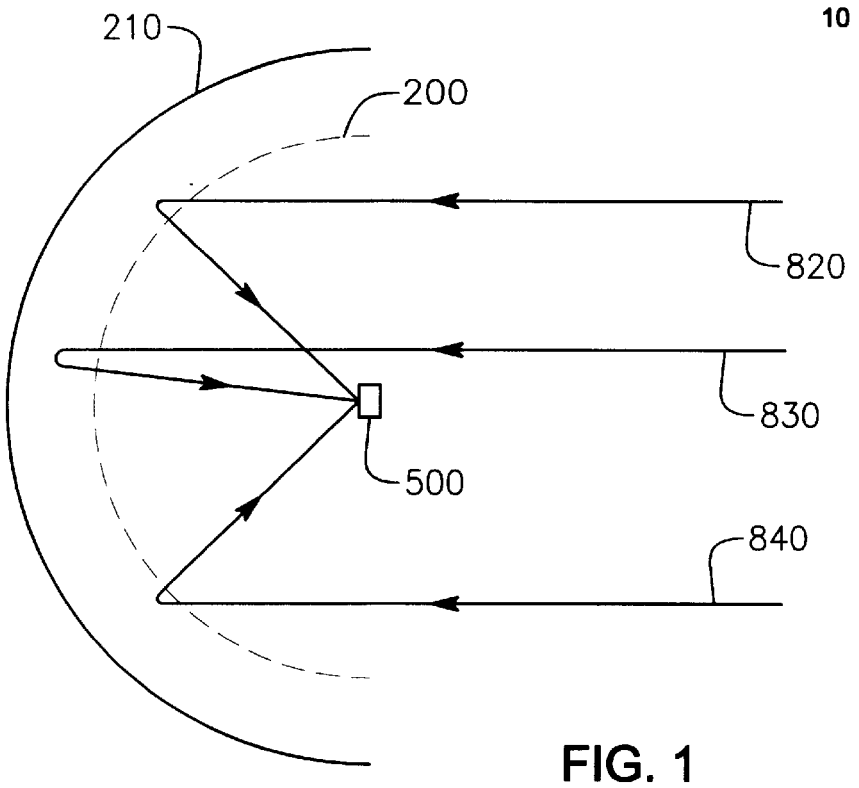
FIG. 1 shows the principle of operation of an electrostatic mirror to focus charged particles at a particle detector.

Turning now to FIG. 1, FIG. 1 shows the principle of operation of an electrostatic mirror to focus charged particles at a particle detector. The electrostatic mirror functions to collect charged particles and to focus these charged particles on a particle detector device. In a simplified configuration, the electrostatic mirror 10 comprises a pair of concentric or non-concentric shaped grids. A particle primary reflection grid 210 has a larger radius than a primary reference grid 200 and is held at an electrical potential different from ground reference electrical potential. The primary reference grid 200 is maintained at ground reference electrical potential and is positioned within the primary particle reflection grid 210. An electrical field is thus created between the primary reference grid 200 and the primary reflection grid 210 that acts to repel charged particles 820, 830, 840 having the same electrical charge as the polarity of the voltage applied to the primary reflection grid 210. By selecting the appropriate shape of the primary reflection grid 210 and the primary reference grid 200, and by selecting the appropriate voltage applied to the primary reflection grid 210, the impinging charged particles of an energy range determined by the voltage on the primary reflection grid 210 are caused to be repelled by the electric field and focused at a focal point where a particle detector 500 is positioned. The voltage applied to the primary reflection grid 210 must be greater than or equal to the energy of the impinging particles of interest, and is typically between 0.1 volts to 10.0 kilovolts. The spacing between the grids is typically between 1.0 millimeter and 10.0 millimeters. The shape of the grids may be parabolic, spherical, cylindrical, or hyperbolic. The focus point can be either on-axis or off-axis. The primary reflection grid 210 may be comprised of either a mesh or a surface. The primary reference grid 200 must be a mesh in order to allow the transmission of charged particles. In a space environment, the primary reference grid 200 also acts as a shield to prevent attraction of charged particles that otherwise would impinge the collector due to the voltage on the primary reflection grid 200. The primary reference grid 200 has the function of shielding the primary reflection grid 210, so that the mirror structure does not look like a charged structure from a distance. A charged structure attracts charged particles of opposite polarity. A charged structure could focus particles towards the structure and the detector 500. The detector 500 would measure a larger or lower particle flux due to the focusing effect, than without the focusing effect. The primary reference grid 200 shields the primary reflection grid 210 with the potential and reduces the structure charging. Charge buildup on the structure may eventually lead to an electrical breakdown of an insulator and thereby damaging the spacecraft or instrument. Due to the nature of a mesh, some field penetration from the underlying primary reflection grid 210 may still occur. The grid size of the primary reference grid 200 should preferably be somewhat smaller than the grid size of the reflector grid 210 to minimize the field penetration but without reducing the transmission too much.

Figure 2:
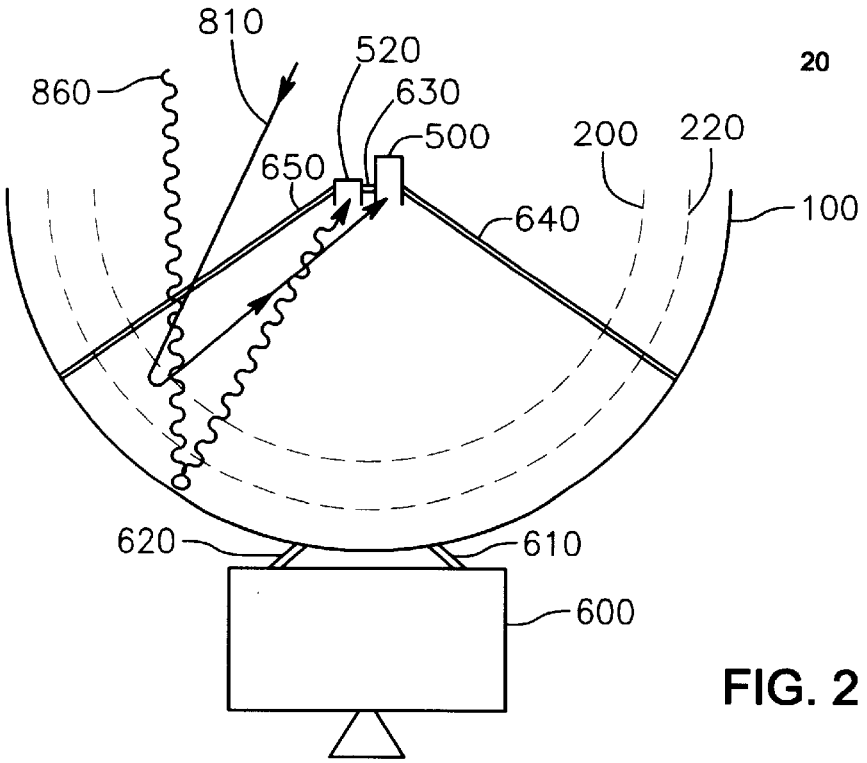
FIG. 2 shows a particle detection system with a single primary particle reflection grid integrated with an antenna and mounted on a spacecraft body.

Turning now to FIG. 2, a preferred embodiment of the system 20 is shown in accordance with the present inventive concepts. FIG. 2 shows a particle detection system with a shaped single primary particle reflection grid 220 and a shaped primary reference grid 200 integrated within a shaped high gain electromagnetic antenna 100 and mounted on a spacecraft body 600 by trusses 610, 620. The primary reference grid 200 is maintained at ground reference electrical potential while the primary particle reflection grid 220 is maintained at an electrical potential sufficient to focus particles of interest 810 at a particle detector 500. The electromagnetic antenna 100 reflects and focuses the electromagnetic radiation 860 at the radiation detector and source 520. The electromagnetic antenna 100 is also maintained at ground reference electrical potential. The particle detector 500 and an electromagnetic detector and source 520 are positioned at a particle focus point and an electromagnetic focus point, respectively, and are held in place by support structure 630, 640, 650. The electromagnetic antenna 100 causes the impinging electromagnetic radiation 860 to be reflected and focused at the electromagnetic focus point where the electromagnetic detector and source 520 are positioned. The operation of the electromagnetic antenna 100 is bilateral in the sense that it also reflects and transmits electromagnetic radiation from the electromagnetic detector and source 520 into space.

The primary reference grid 200, the primary reflection grid 220, and the electromagnetic antenna 100 may be concentric or non-concentric, or they may have focus points that are on-axis or off-axis. The voltage on the primary reflection grid 200 may be varied to select an energy range of charged particles to be collected and focused on the particle detector.

The shape of the primary reference grid 200, the primary reflection grid 220 and the electromagnetic antenna 100 need not be the same, and may be parabolic, spherical, cylindrical, hyperbolic, or any other surface of second order or higher. A surface of second order is defined by a set of points whose x, y, and z coordinates satisfy the following relation:

$$a_{11}x^2+a_{22}y^2+a_{33}z^2+2a_{12}xy+2a_{13}xz+2a_{23}yz+2a_1x+2a_2y+2a_3z+a=0.$$

This can be rewritten by the use of main axis transformation to:

$$\lambda_1x^2+\lambda_2y^2+\lambda_3z^2+d=0.$$

In the case of a singular matrix, this becomes:

$$\lambda_1x^2+\lambda_2y^2+mz+n=0,$$

where $\lambda_i$ are the eigenvalues. The coordinate axis are the symmetry axis of the surface. Depending on the value of the coefficients $\lambda_i$ and d, one gets different surfaces such as paraboloids, hyperboloids, ellipsoids, elliptical and hyperbolic paraboloids, cylinders, spheres, cones, etc. By use of appropriate coefficients, surfaces of higher order can be fit to surfaces of second order. In a typical embodiment of the present invention, sections of a surface of second or higher order may be used.

The particle detector 500 may be either a mass spectrometer, a solid-state detector, a Faraday cup, a plasma analyzer, a channel electron multiplier, a microchannel plate detector, a microsphere plate detector, a carbon foil detector, a metal foil detector, a gas detector, a photomultiplier, or a photographic detector. This list of detectors is not all inclusive. A very broad range of particle detectors and sensors is known to those skilled in the relevant art. The basis of all current detection devices is the interaction of radiation with matter. Depending on the type of radiation, its energy and the type of material, reactions with the atoms or nuclei as a whole or with their individual constituents may occur through whatever channels are allowed. For charged particles and photons, the most common processes are by far the electromagnetic interactions, in particular, inelastic collisions with atomic electrons. Charged particles transfer heir energy to matter through direct collisions with the atomic electrons, thus inducing excitation or ionization of the atoms. Neutral radiation, on the other hand, must first undergo some sort of reaction in the detector producing charged particles, which in turn ionize and excite the detector atoms. The form in which the converted energy appears depends on the detector and its design. The gaseous detectors are designed to directly collect the ionization electrons to form a current signal, while in scintillators, both the excitation and ionization contribute to inducing molecular transitions which result in the emission of light. Similarly, in photographic emulsions, the ionization induces chemical reactions which allow a track image to be formed, and so on. Modern detectors today are essentially electrical in nature, i.e., at some point along the way the information from the detector is transformed into electrical impulses which can be treated by electronic means. Typical detectors employed are microchannel plates, microsphere plates, solid state devices, electron multipliers, channel electron multipliers, fluorescence and phosphorescence materials, photographic emulsions, particle trapping materials like gel and foils, scintillators and photomultipliers and ionization devices like proportional counters. Detectors often include some sort of filter, to detect a selected group of particles or photons. A detector and a filter are often referred to as a sensor or sensor head. A filter for particles can consist of an electrostatic analyzer, an electric field, a magnetic field, a foil, gratings, and combinations thereof. Typical modern day particle sensors are mass spectrometers, electrostatic analyzers, solid state detectors, semiconductors, foil-based devices, and proportional counters.

If either the primary reference grid 200 or the primary reflection grid 220 have a mesh size that is significantly larger than the wavelength of the impinging electromagnetic radiation 860, the impinging electromagnetic radiation 860 will be transmitted through the grid with little or no attenuation. However, if either the primary reference grid 200 or the primary reflection grid 220 have a mesh size that is significantly smaller than the wavelength of the impinging electromagnetic radiation 860, the impinging electromagnetic radiation 860 will be mostly reflected by the grid. The result is that the primary reference grid 200 and the primary particle grid 220 may perform like a high-pass filter for the electromagnetic radiation 860. A solid parabolic reflector is a completely frequency independent surface. The same holds true for a mesh parabolic reflector provided that the mesh size is less than between one-tenth and one-twelfth of the wavelength of the impinging electromagnetic radiation $\lambda_0$. If the mesh size is larger than one-tenth $\lambda_0$, then electromagnetic radiation with a wavelength A greater than $\lambda_0$ has a higher reflection coefficient than electromagnetic radiation with a wavelength $\lambda$ less than $\lambda_0$, and visa versa. This property may be exploited by the configuration shown in FIG. 3.

Figure 3:
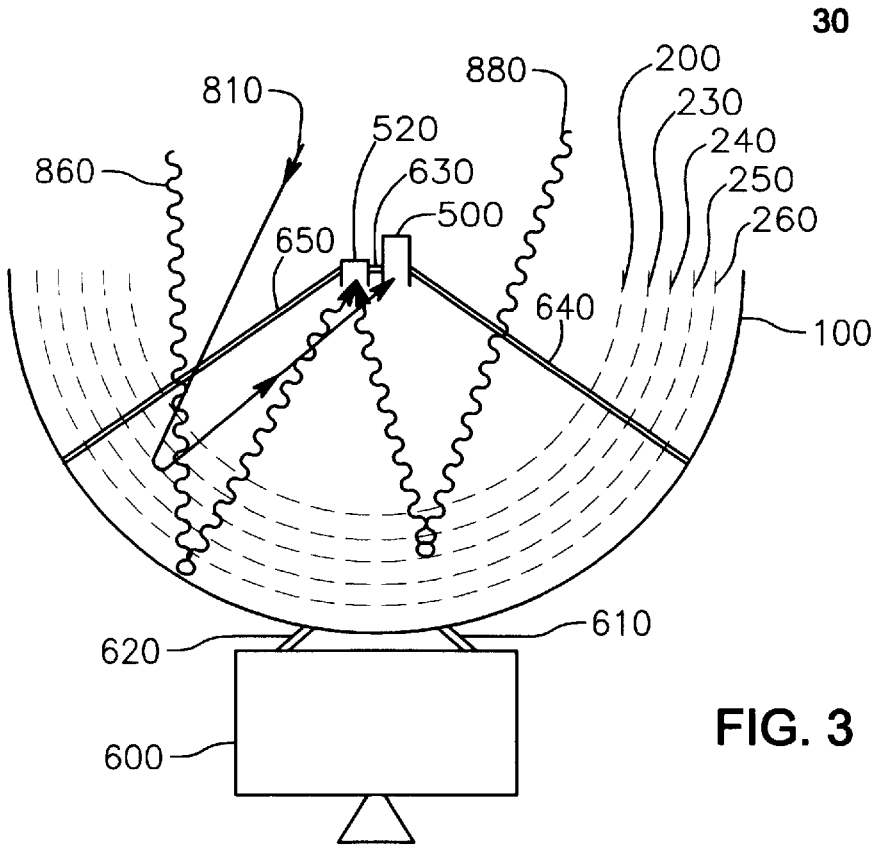
FIG. 3 shows a particle detection system with a plurality of primary particle reflection grids integrated with an antenna and mounted on a spacecraft body.

FIG. 3 depicts another embodiment of the invention 30 similar to that shown, but where the single primary reflection grid 220 of FIG. 2 is replaced by a plurality of primary reflection grids 230, 240, 250, 260, in FIG. 3. If the mesh size for each of the primary reflection grids 230, 240, 250, 260, is progressively decreased for each grid position progressively closer to the dish antenna 100, the incident electromagnetic radiation having wavelengths less than the respective mesh size will be transmitted through the mesh and the incident electromagnetic radiation greater than the respective mesh size will be reflected from the mesh. This provides for selective focusing of incident electromagnetic radiation. This is depicted in FIG. 3 where incident long wavelength electromagnetic radiation 880 has a wavelength smaller than the mesh size of the primary reference grid 200 and the primary reflection grid 230, but has a wavelength greater than the mesh size of primary reflection grid 240 where it is reflected. Similarly, short wavelength electromagnetic radiation 860 has a wavelength shorter than the mesh size of all the grids and is reflected from the electromagnetic antenna. The plurality of primary reflection grids 230, 240, 250, 260, may also be maintained at differing electrical potentials for selective focusing of charged particles.

Figure 4:
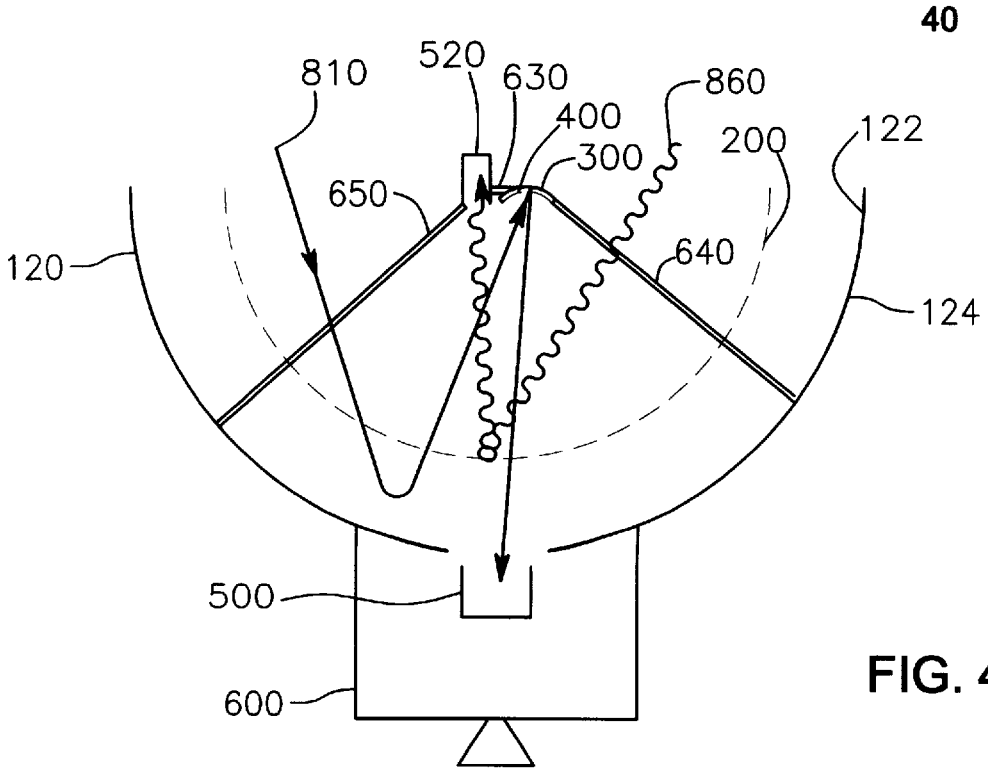
FIG. 4 shows a particle detection system having double particle reflecting mirrors integrated with an antenna having a single electromagnetic reflecting surface and mounted on a spacecraft body.

Turning now to FIG. 4, an alternate embodiment of the system 40 is shown in accordance with the present inventive concepts. The configuration shown in FIG. 4 is comprised of a primary reference grid 200 and the electromagnetic antenna 120, where the electromagnetic antenna also functions as a primary reflection grid. In one embodiment, the entire electromagnetic antenna 120 or the inner surface 122 of the electromagnetic antenna 120 is conductive and is maintained at an electrical potential, functioning as both a primary reflection grid for charged particles 810 and an electromagnetic reflector for electromagnetic radiation 860. The preferred variation of this embodiment is where the inner surface 122 of the electromagnetic antenna 120 is a conductive mesh maintained at an electrical potential for reflecting charged particles 810, and the outer surface 124 of the electromagnetic antenna 120 is a conductive surface maintained at electrical ground reference potential.

In addition to the primary reflection grid configuration, FIG. 4 also depicts a secondary reference grid 400 and a secondary reflection grid 300 positioned at the particle focus point of the primary reflection grid 122 and the primary reference grid 200. The secondary reference grid 400 and the secondary reflection grid 300 function as a secondary electrostatic mirror, causing the charged particles to be focused at a secondary particle focus point where a particle detector 500 is positioned behind an aperture in the electromagnetic antenna 120 opposite the secondary reflection grid 300 and the secondary reference grid 400. Alternatively, the charged particles 810 are focused at the secondary particle focus point where the particle detector 500 is positioned adjacent to the electromagnetic antenna 120 and on the same side of the antenna 120 as the secondary reference grid 400. The secondary reference grid 400 and the secondary reflection grid 300 may be either convex-shaped or concave-shaped. The secondary reflection grid 300 may be either a grid or a surface. Although the primary reference grid 200 may be either electromagnetic reflective or transmissive, depending on the mesh size relative to the wavelength of the incident electromagnetic radiation 860, FIG. 4 depicts a primary reference grid 200 having a smaller mesh size than the incident electromagnetic radiation 860, causing the electromagnetic radiation 860 to be reflected to the electromagnetic detector and source 520.

Figure 5:
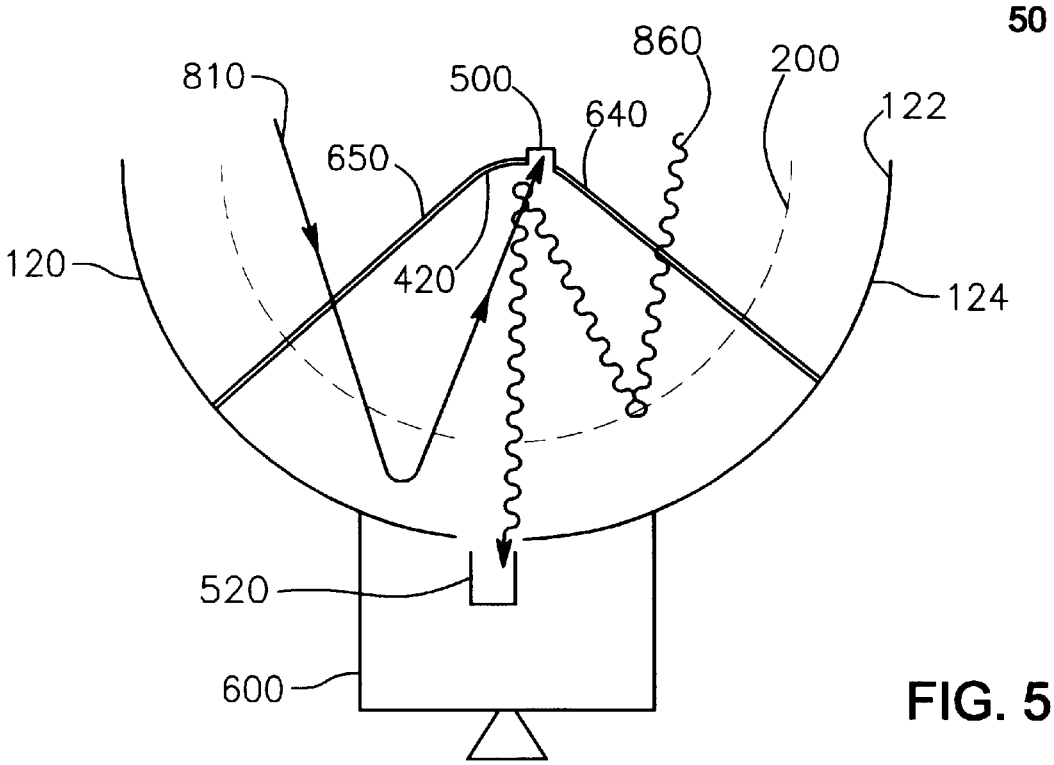
FIG. 5 shows a particle detection system having a single particle reflecting mirror integrated with an antenna having double electromagnetic reflecting surfaces and mounted on a spacecraft body.

Turning to FIG. 5, an alternate embodiment of the system 50 is shown in accordance with the present inventive concepts. FIG. 5 shows a particle detection system having a single particle reflecting mirror integrated with an antenna having double electromagnetic reflecting surfaces and mounted on a spacecraft body. The operation of the primary reference grid 200, the electromagnetic antenna 120, the inner surface 122 of the electromagnetic antenna 120, and the outer surface 124 of the electromagnetic antenna 120 for reflecting and focusing charged particles 810 and electromagnetic radiation 860 is the same as depicted in FIG. 4, and previously described. FIG. 5 shows the charged particles 810 focused on the particle detector 500 located at the primary particle focus point by the electric field between the primary reference grid 200 and the primary reflection grid 122. FIG. 5 also depicts a primary reference grid 200 having a mesh size that is less than the wavelength of the impinging electromagnetic radiation 860, causing the radiation 860 to be focused at a secondary electromagnetic reflecting means 420. The secondary electromagnetic reflecting means 420 causes the impinging radiation 860 to be reflected through an aperture in the primary reference grid 200 and an aperture in the electromagnetic antenna 120 to an electromagnetic radiation detector and source 520. The electromagnetic radiation detector and source 520 is positioned on the opposite side of the antenna 120 from the secondary electromagnetic reflecting means 420. Alternatively, the electromagnetic radiation detector and source 520 is positioned adjacent to the same side of the electromagnetic antenna 120 as the secondary electromagnetic reflecting means 420.

Figure 6:
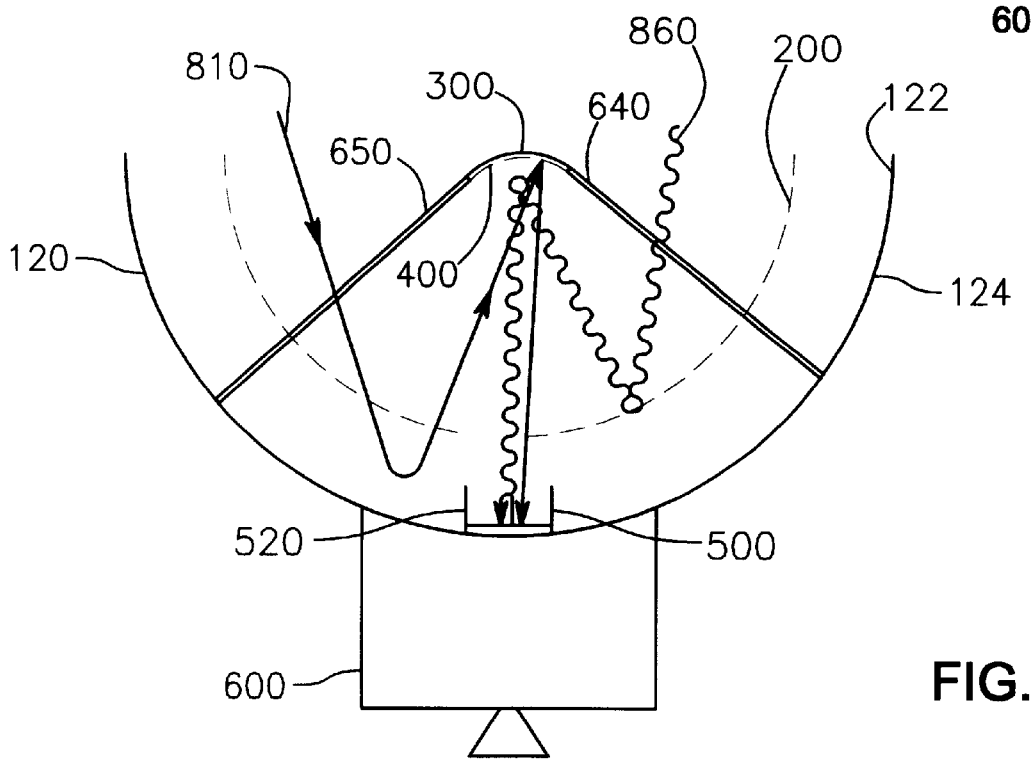
FIG. 6 shows a particle detection system having double particle reflecting mirrors integrated with an antenna having double electromagnetic reflecting surfaces and mounted on a spacecraft body.

Turning now to FIG. 6, an alternate embodiment of the system 60 is shown in accordance with the present inventive concepts. FIG. 6 shows a particle detection system having double particle reflecting mirrors integrated with an antenna having double electromagnetic reflecting surfaces and mounted on a spacecraft body. The operation of the primary reflection grid 122 and secondary reflection grid 300 in reflecting and focusing charged particles 810 at the particle detector 500 is the same as depicted in FIG. 4, and previously described. FIG. 6 also depicts a primary reference grid 200 having a mesh size that is less than the wavelength of the impinging electromagnetic radiation 860, causing the radiation 860 to be focused at the secondary reflection grid 300 and the secondary reference grid 400. The mesh size of either the secondary reflection grid 300 or the secondary reference grid 400 is less than the wavelength of the impinging radiation 860, causing the impinging radiation 860 on the secondary reflection grid 300 and the secondary reference grid 400 to be reflected through an aperture in the primary reference grid 200 to an electromagnetic radiation detector and source 520 positioned adjacent to the same side of the electromagnetic antenna 120 as the secondary reference grid 400. Alternatively, the electromagnetic radiation detector and source 520 and the particle detector 500 are positioned on the opposite side of the antenna 120 from the secondary reflection grid 300 and the secondary reference grid 400.

Figure 7:
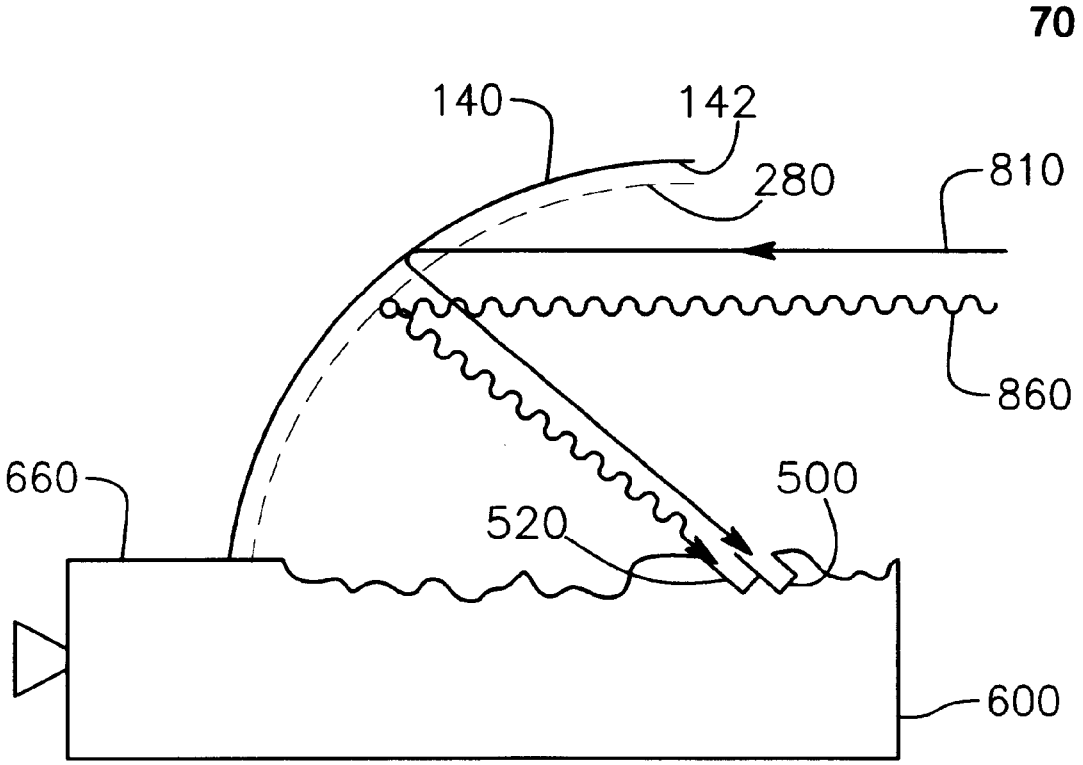
FIG. 7 shows an off-axis configuration of an particle detection system integrated with an antenna and mounted on a spacecraft body in order to reduce obstruction of collection of the main reflector by the detectors or secondary mirrors.

Turning now to FIG. 7, an alternate embodiment of the system 70, is shown in accordance with the present inventive concepts. FIG. 7 shows an off-axis configuration of an particle detection system integrated with an antenna and amounted on a spacecraft body in order to reduce obstruction of the main reflector by the detectors or secondary mirrors. A shaped electromagnetic dish antenna 140 having an inner surface 142 maintained at an electrical potential for reflecting charged particles, and positioned above a surface 660 of a spacecraft body 600. A primary particle reference grid 280 is positioned within the electromagnetic antenna 140 and is maintained at a ground reference electrical potential. An electric field between the inner surface 142 of the electromagnetic antenna 140 and the primary reference grid 280 causes impinging charged particles 810 to be reflected and focused at a particle detector 500 positioned on the surface 660. By selecting a small mesh size for the primary reference grid 280 relative to the wavelength of the impinging electromagnetic radiation 860, the impinging electromagnetic radiation 860 is caused to be reflected and focused at an electromagnetic detector and source 520 positioned on the surface 660. The electromagnetic antenna 140 may also cause impinging electromagnetic radiation 860 to be reflected and focused at an electromagnetic detector and source 520 positioned on the surface 660, if the mesh size of the primary reference grid is sufficiently large with respect to the wavelength of the impinging electromagnetic radiation 860. The primary reference grid 280 and the electromagnetic antenna 140 may be either concentric or non-concentric, and may be either partial parabolic-shaped, partial spherical-shaped, partial cylindrical-shaped, or partial hyperbolic-shaped. The electrical potential on the primary reflection grid on the inside surface 142 of the electromagnetic antenna 140 may be varied to reflect charged particles 610 having a selected energy range. The mesh size of the primary reference grid 280 may be selected to cause either reflection or transmission of the impinging electromagnetic radiation 860.

There are many other possible configurations that are conceivable under the disclosed inventive concept in order to provide the described benefits and advantages. These include other possible configurations of the spacecraft body and integrated collector, a plurality of electrostatic mirrors and a plurality of electromagnetic reflectors, and other possible detector instrumentation. The embodiments described above disclose a highly integrated electromagnetic antenna and particle collection system that satisfies the need for a large collection area to collect as many particles as possible in a tenuous medium in order to increase sensitivity and to allow for shorter electrical integration times of the particle count signal input.

Although the present invention has been described in considerable detail with reference to certain preferred embodiments thereof, other embodiments are possible. Therefore, the spirit and scope of the appended claims should not be limited to the description of the preferred embodiments herein.

What is claimed is:

1. A particle collector with integrated antenna, comprising:

(a) a shaped dish antenna for transmitting and receiving incident electromagnetic radiation having an antenna radius and an electromagnetic focus point for incident electromagnetic radiation;

(b) a shaped, electrically conductive primary particle reflection grid having a smaller primary reflection grid radius than the dish antenna radius and positioned within the dish antenna, the primary reflection grid being held at an electrical potential for reflecting electrically charged particles;

(c) a shaped, electrically conductive primary reference grid having a smaller primary reference grid radius than the primary reflection grid radius and positioned within the primary reflection grid, the primary reference grid being held at a ground reference electrical potential, the primary reflection grid and the primary reference grid having a common particle focus point for the reflected electrically charged particles;

(d) an electromagnetic radiation detector and source positioned at the electromagnetic focus point; and (e) a particle detector positioned at the particle focus point.

2. A particle collector with integrated antenna, according to claim 1, wherein:

(a) the antenna has an inner surface nearest to the electromagnetic focus point and an outer surface opposite the inner surface;

(b) the primary reflection grid is superimposed on the inner surface of the antenna, the primary reflection grid being held at an electrical potential for reflecting the electrically charged particles to the particle detector; and (c) the outer surface of the antenna is an electrically conductive surface being held at the ground reference electrical potential for reflecting the incident electromagnetic radiation to the electromagnetic radiation detector and source.

3. A particle collector with integrated antenna, according to claim 2, wherein the primary reference grid has a mesh size that is less than the wavelength of the incident electromagnetic radiation for reflecting the incident electromagnetic radiation to the electromagnetic radiation detector and source.

4. A particle collector with integrated antenna, according to claim 1, wherein:

(a) the antenna has an inner surface nearest to the electromagnetic focus point and an outer surface opposite the inner surface;

(b) the primary reflection grid is superimposed on the inner surface of the antenna, the primary reflection grid being held at an electrical potential for reflecting the electrically charged particles to the particle detector; and (c) the inner surface comprising the primary reflection grid is an electrically conductive surface for reflecting the incident electromagnetic radiation to the electromagnetic radiation detector and source.

5. A particle collector with integrated antenna, according to claim 1, wherein the shape of the dish antenna is derived from surfaces of second or higher order.

6. A particle collector with integrated antenna, according to claim 1, wherein the shape of the dish antenna is selected from a group consisting of parabolic, spherical, cylindrical, and hyperbolic.

7. A particle collector with integrated antenna, according to claim 1, wherein the shape of the primary particle reflection grid is derived from surfaces of second or higher order.

8. A particle collector with integrated antenna, according to claim 1, wherein the shape of the primary particle reflection grid is selected from a group consisting of parabolic, spherical, cylindrical, and hyperbolic.

9. A particle collector with integrated antenna, according to claim 1, wherein the shape of the primary reference grid is derived from surfaces of second or higher order.

10. A particle collector with integrated antenna, according to claim 1, wherein the shape of the primary reference grid is selected from a group consisting of parabolic, spherical, cylindrical, and hyperbolic.

11. A particle collector with integrated antenna, according to claim 1, wherein the particle detector is selected from a group consisting of a mass spectrometer, a solid-state detector, a Faraday cup, a plasma analyzer, a channel electron multiplier, a microchannel plate detector, a microsphere plate detector, a carbon foil detector, a metal foil detector, a gas detector, a photomultiplier, and a photographic detector.

12. A particle collector with integrated antenna, according to claim 1, wherein the primary particle reflection grid has a mesh size that attenuates transmission and enhances reflection of incident electromagnetic radiation having wavelengths greater than the mesh size, and enhances transmission and attenuates reflection of incident electromagnetic radiation having wavelengths less than the mesh size.

13. A particle collector with integrated antenna, according to claim 1, wherein the primary reference grid has a mesh size that attenuates transmission and enhances reflection of incident electromagnetic radiation having wavelengths greater than the mesh size, and enhances transmission and attenuates reflection of incident electromagnetic radiation having wavelengths less than the mesh size.

14. A particle collector with integrated antenna, according to claim 1, wherein the electrical potential on the primary particle reflection grid relative to the ground reference electrical potential on the primary reference grid is varied to select an energy range of the charged particles to be collected and focused at the particle detector.

15. A particle collector with integrated antenna, according to claim 1, wherein the shaped primary particle reflection grid is concentric with the shaped primary reference grid and concentric with the shaped dish antenna.

16. A particle collector with integrated antenna, according to claim 1, wherein the shaped primary particle reflection grid is concentric with the shaped primary reference grid and is non-concentric with the shaped dish antenna.

17. A particle collector with integrated antenna, according to claim 1, wherein the shaped primary particle reflection grid is concentric with the shaped dish antenna and is non-concentric with the shaped primary reference grid.

18. A particle collector with integrated antenna, according to claim 1, wherein the shaped primary particle reflection grid is non-concentric with the shaped primary reference grid, and the shaped primary reference grid is non-concentric with the shaped dish antenna.

19. A particle collector with integrated antenna, according to claim 1, wherein the shaped primary particle reflection grid is non-concentric with the shaped dish antenna, and the shaped primary reference grid is concentric with the shaped dish antenna.

20. A particle collector with integrated antenna, according to claim 1, wherein the primary reference grid has a mesh size that is smaller than the mesh size of the primary particle reflection grid to minimize electric field penetration into space without substantially reducing transmission of incident electromagnetic radiation.

21. A particle collector with integrated antenna, according to claim 1, further comprising a plurality non-concentric shaped, electrically conductive primary particle reflection grids positioned within the dish antenna and spaced between the dish antenna and the primary reference grid.

22. A particle collector with integrated antenna, according to claim 21, wherein the mesh size for each of the plurality of primary particle reflection grids is progressively decreased for each grid position progressively closer to the dish antenna for selectively transmitting the incident electromagnetic radiation having wavelengths less than the respective mesh size, and selectively reflecting the incident electromagnetic radiation having wavelengths greater than the respective mesh size.

23. A particle collector with integrated antenna, according to claim 21, further comprising an electrical potential that is applied to each of the plurality of primary particle reflection grids, the electrical potential applied is progressively increased for each grid position progressively closer to the dish antenna for selectively reflecting charged particles with progressively increasing energy.

24. A particle collector with integrated antenna, according to claim 1, wherein the primary reference grid has a mesh size that is less than the wavelength of the incident electromagnetic radiation for reflecting the incident electromagnetic radiation to the electromagnetic radiation detector and source.

25. A particle collector with integrated antenna, comprising:

(a) a shaped dish antenna for transmitting and receiving incident electromagnetic radiation having an antenna radius and an electromagnetic focus point for electromagnetic radiation;

(b) a shaped, electrically conductive primary particle reflection grid having a smaller primary reflection grid radius than the dish antenna radius and positioned within the dish antenna, the primary reflection grid being held at an electrical potential for reflecting electrically charged particles;

(c) a shaped, electrically conductive primary reference grid having a smaller primary reference grid radius than the primary reflection grid radius and positioned within the primary reflection grid, the primary reference grid being held at a ground reference electrical potential, the primary reflection grid and the primary reference grid having a common particle focus point for the electrically charged particles;

(d) an electromagnetic radiation detector and source positioned at the electromagnetic focus point;

(e) a concave-shaped, electrically conductive secondary particle reflection grid positioned at the common particle focus point, the secondary reflection grid having a secondary reflection grid radius and being held at a secondary electrical potential for reflecting electrically charged particles;

(f) a concave-shaped, electrically conductive secondary reference grid having a smaller secondary reference grid radius than the secondary reflection grid radius and positioned within the secondary reflection grid, the secondary reference grid being held at the ground reference electrical potential, the secondary reflection grid and the secondary reference grid having a common secondary particle focus point for charged particles, the secondary particle focus point being positioned behind an aperture in the antenna opposite the common particle focus point; and (g) a particle detector positioned at the secondary particle focus point.

26. A particle collector with integrated antenna, according to claim 25, wherein the secondary reflection grid is a surface.

27. A particle collector with integrated antenna, according to claim 25, wherein:

(a) the antenna has an inner surface nearest to the electromagnetic focus point and an outer surface opposite the inner surface;

(b) the primary reflection grid is superimposed on the inner surface of the antenna, the primary reflection grid being held at an electrical potential for reflecting the electrically charged particles to the secondary reflection grid; and (c) the outer surface of the antenna is an electrically conductive surface being held at the ground reference electrical potential for reflecting the incident electromagnetic radiation to the electromagnetic radiation detector and source.

28. A particle collector with integrated antenna, according to claim 27, wherein the primary reference grid has a mesh size that is less than the wavelength of the incident electromagnetic radiation for reflecting the incident electromagnetic radiation to the electromagnetic radiation detector and source.

29. A particle collector with integrated antenna, according to claim 25, wherein the primary reference grid has a mesh size that is less than the wavelength of the incident electromagnetic radiation for reflecting the incident electromagnetic radiation to the electromagnetic radiation detector and source.

30. A particle collector with integrated antenna, according to claim 25, wherein the secondary reflection grid is convex-shaped and the secondary reference grid is convex-shaped.

31. A particle collector with integrated antenna, comprising:

(a) a shaped dish antenna for transmitting and receiving incident electromagnetic radiation having an antenna radius and an electromagnetic focus point for electromagnetic radiation;

(b) a shaped, electrically conductive primary particle reflection grid having a smaller primary reflection grid radius than the dish antenna radius and positioned within the dish antenna, the primary reflection grid being held at an electrical potential for reflecting electrically charged particles;

(c) a shaped, electrically conductive primary reference grid having a smaller primary reference grid radius than the primary reflection grid radius and positioned within the primary reflection grid, the primary reference grid being held at a ground reference electrical potential, the primary reflection grid and the primary reference grid having a common particle focus point for the electrically charged particles;

(d) a particle detector positioned at the particle focus point;

(e) a secondary electromagnetic reflecting means positioned at the electromagnetic focus point for reflecting and focusing the incident electromagnetic radiation at a secondary electromagnetic focus point, the secondary electromagnetic focus point being positioned behind a primary reference grid aperture and an aperture in the antenna; and (f) an electromagnetic radiation detector and source positioned at the secondary electromagnetic focus point.

32. A particle collector with integrated antenna, according to claim 31, wherein:

(a) the antenna has an inner surface nearest to the electromagnetic focus point and an outer surface opposite the inner surface;

(b) the primary reflection grid is superimposed on the inner surface of the antenna, the primary reflection grid being held at an electrical potential for reflecting electrically charged particles to the secondary reflection grid; and (c) the outer surface of the antenna is an electrically conductive surface being held at the ground reference electrical potential for reflecting the incident electromagnetic radiation to the secondary electromagnetic reflecting means.

33. A particle collector with integrated antenna, according to claim 32, wherein the primary reference grid has a mesh size that is less than the wavelength of the incident electromagnetic radiation for reflecting the incident electromagnetic radiation to the electromagnetic radiation detector and source.

34. A particle collector with integrated antenna, according to claim 31, wherein the primary reference grid has a mesh size that is less than the wavelength of the incident electromagnetic radiation for reflecting the incident electromagnetic radiation to the electromagnetic radiation detector and source.

35. A particle collector with integrated antenna, according to claim 31, wherein the secondary electromagnetic reflecting means is concave-shaped.

36. A particle collector with integrated antenna, according to claim 31, wherein the secondary electromagnetic reflecting means is convex-shaped.

37. A particle collector with integrated antenna, comprising:

(a) a shaped dish antenna for transmitting and receiving incident electromagnetic radiation having an antenna radius and an electromagnetic focus point for electromagnetic radiation;

(b) a shaped, electrically conductive primary particle reflection grid having a smaller primary reflection grid radius than the dish antenna radius and positioned within the dish antenna, the primary reflection grid being held at an electrical potential for reflecting electrically charged particles;

(c) a shaped, electrically conductive primary reference grid having a smaller primary reference grid radius than the primary reflection grid radius and positioned within the primary reflection grid, the primary reference grid being held at a ground reference electrical potential, the primary reflection grid and the primary reference grid having a common particle focus point for the electrically charged particles;

(d) a concave-shaped, electrically conductive secondary particle reflection grid positioned at the common particle focus point, the secondary reflection grid having a secondary reflection grid radius and being held at a secondary electrical potential for reflecting electrically charged particles;

(e) a concave-shaped, electrically conductive secondary reference grid having a smaller secondary reference grid radius than the secondary reflection grid radius and positioned within the secondary reflection grid, the secondary reference grid being held at the ground reference electrical potential, the secondary reflection grid and the secondary reference grid having a common secondary particle focus point for charged particles, the secondary particle focus point being positioned adjacent to the antenna;

(f) a particle detector positioned at the secondary particle focus point;

(g) a secondary electromagnetic reflecting means positioned at the electromagnetic focus point for reflecting and focusing the incident electromagnetic radiation at a secondary electromagnetic focus point, the secondary electromagnetic focus point being positioned behind a primary reference grid aperture and adjacent to the antenna; and (h) an electromagnetic radiation detector and source positioned at the secondary electromagnetic focus point.

38. A particle collector with integrated antenna, according to claim 37, wherein the secondary electromagnetic reflecting means is the secondary reference grid having a mesh size smaller than the wavelength of the incident electromagnetic radiation.

39. A particle collector with integrated antenna, according to claim 37, wherein the secondary electromagnetic reflecting means is the secondary reflection grid having a mesh size smaller than the wavelength of the incident electromagnetic radiation.

40. A particle collector with integrated antenna, according to claim 37, wherein the secondary reflection grid is a surface.

41. A particle collector with integrated antenna, according to claim 37, wherein:

(a) the antenna has an inner surface nearest to the electromagnetic focus point and an outer surface opposite the inner surface;

(b) the primary reflection grid is superimposed on the inner surface of the antenna, the primary reflection grid being held at an electrical potential for reflecting electrically charged particles to the secondary reflection grid; and (c) the outer surface of the antenna is an electrically conductive surface being held at the ground reference electrical potential for reflecting the incident electromagnetic radiation to the secondary electromagnetic reflecting means.

42. A particle collector with integrated antenna, according to claim 41, wherein the primary reference grid has a mesh size that is less than the wavelength of the incident electromagnetic radiation for reflecting the incident electromagnetic radiation to the electromagnetic radiation detector and source.

43. A particle collector with integrated antenna, according to claim 37, wherein the primary reference grid has a mesh size that is less than the wavelength of the incident electromagnetic radiation for reflecting the incident electromagnetic radiation to the electromagnetic radiation detector and source.

44. A particle collector with integrated antenna, according to claim 37, wherein the secondary reflection grid is convex-shaped and the secondary reference grid is convex-shaped.

45. A particle collector with integrated antenna, according to claim 37, wherein the secondary electromagnetic reflecting means is concave-shaped.

46. A particle collector with integrated antenna, according to claim 37, wherein the secondary electromagnetic reflecting means is convex-shaped.

47. A particle collector with integrated antenna, comprising:

(a) a shaped dish antenna positioned above a surface for transmitting and receiving incident electromagnetic radiation, the dish antenna having an antenna radius and an electromagnetic focus point on the surface for the incident electromagnetic radiation;

(b) a shaped, electrically conductive primary particle reflection grid positioned above the surface, having a smaller primary reflection grid radius than the dish antenna radius and positioned within the dish antenna, the primary reflection grid being held at an electrical potential for reflecting electrically charged particles;

(c) a shaped, electrically conductive primary reference grid positioned above the surface, having a smaller primary reference grid radius than the primary reflection grid radius and positioned within the primary reflection grid, the primary reference grid being held at a ground reference electrical potential, the primary reflection grid and the primary reference grid having a common particle focus point on the surface for the electrically charged particles;

(d) an electromagnetic radiation detector and source positioned at the electromagnetic focus point on the surface; and (e) a particle detector positioned at the particle focus point on the surface.

48. A particle collector with integrated antenna, according to claim 47, wherein:

(a) the dish antenna has an inner surface nearest to the electromagnetic focus point and an outer surface opposite the inner surface;

(b) the primary reflection grid is superimposed on the inner surface of the antenna, the primary reflection grid being held at an electrical potential for reflecting the electrically charged particles to the particle detector; and (c) the outer surface of the antenna is an electrically conductive surface being held at the ground reference electrical potential for reflecting the incident electromagnetic radiation to the electromagnetic radiation detector and source.

49. A particle collector with integrated antenna, according to claim 48, wherein the primary reference grid has a mesh size that is less than the wavelength of the incident electromagnetic radiation for reflecting the incident electromagnetic radiation to the electromagnetic radiation detector and source.

50. A particle collector with integrated antenna, according to claim 47, wherein the primary reference grid has a mesh size that is less than the wavelength of the incident electromagnetic radiation for reflecting the incident electromagnetic radiation to the electromagnetic radiation detector and source.

51. A particle collector with integrated antenna, according to claim 47, wherein the electrical potential on the primary particle reflection grid relative to the ground reference electrical potential on the primary reference grid is varied to select an energy range of the charged particles to be collected and focused at the particle detector.

52. A particle collector with integrated antenna, according to claim 47, wherein the shape of the dish antenna is selected from a group consisting of partial parabolic, partial spherical, partial cylindrical, and partial hyperbolic.

53. A particle collector with integrated antenna, according to claim 47, wherein the shape of the primary particle reflection grid is selected from a group consisting of partial parabolic, partial spherical, partial cylindrical, and partial hyperbolic.

54. A particle collector with integrated antenna, according to claim 47, wherein the shape of the primary reference grid is selected from a group consisting of partial parabolic, partial spherical, partial cylindrical, and partial hyperbolic.

* * * * *